United States Patent [19]

Duckett

[11] 4,219,228

[45] Aug. 26, 1980

[54] CONTAINER-HANDLING SPREADER BEAM OR THE LIKE

[75] Inventor: Frederick L. Duckett, Bath, England

[73] Assignee: Stothert & Pitt Limited, Bath, England

[21] Appl. No.: 12,357

[22] Filed: Feb. 15, 1979

[30] Foreign Application Priority Data

Feb. 17, 1978 [GB] United Kingdom ..... 6407/78

[51] Int. Cl.[2] ..... B66C 1/22

[52] U.S. Cl. ..... 294/81 SF; 294/67 DA

[58] Field of Search ..... 294/315 F, 81 R, 67 R, 294/67 DA, 67 DB, 67 BB, 67 BC; 414/707, 708

[56] References Cited

U.S. PATENT DOCUMENTS

| | | | |
|---|---|---|---|
| 3,749,438 | 7/1973 | Loomis et al. | 294/81 SF |
| 3,751,096 | 8/1973 | Wyon | 294/81 SF |

*Primary Examiner*—James B. Marbert

*Attorney, Agent, or Firm*—Frost & Jacobs

[57] ABSTRACT

A container-handling spreader beam for use both with "Sealand" and I.S.O. containers which have differently spaced transversely disposed pairs of corner castings. The spreader beam has pairs of twistlock assemblies and each twistlock assembly is resiliently held on the spreader beam frame structure so that it is transversely movable on the frame structure to cater for the differently spaced corner castings of the two types of container.

17 Claims, 9 Drawing Figures

CONTAINER-HANDLING SPREADER BEAM OR THE LIKE

This invention relates to a container-handling spreader beam or the like.

It has now become standard practice, when lifting containers from the top, for example using container handling cranes, to use twistlocks mounted on a spreader beam, the twistlocks being adapted to engage apertured castings provided on the corners of the containers. However, there are several container systems in current use, these having different sizes and shapes of apertured corner castings and different lifting centres. Therefore, difficulties can arise in the mixed handling of containers.

Two widely used container systems which are encountered in mixed handling operations are the International Standards Organisation system (hereinafter referred to as the I.S.O. system) and the "Sealand" system.

The corner castings used in these two systems differ in shape and size of the top aperture and in various details of casting thickness. In addition, containers of the I.S.O. system are of various lengths, whilst containers of the "Sealand" system are of one length which is intermediate that of the I.S.O. container lengths. Although the widths of the containers in the two systems are similar, there is a difference in the transverse lifting centres, i.e. the centre-to-centre spacing of the top apertures of the corner castings, which is significant when considering the question of engagement of the twistlocks in the corner castings during mixed handling.

The differences in length of the containers can be catered for by using a telescopic type of spreader beam. Also twistlocks can, and have been designed which will engage the top aperture of either type of corner casting when positioned on the spreader beam at approximately the correct transverse spacing. However, difficulty arises in this case in ensuring that the twistlocks will readily move from the transverse spacing of one system to that of the other system, even though adequate horizontal float is provided in the lifting spreader, and the maximum lead-in is provided on the twistlock head.

It is among the objects of the present invention to provide a spreader beam or the like having twistlock arrangements which avoid the aforementioned problems and enable the spreader beam to be used effectively for handling both I.S.O. and "Sealand" containers.

According to the present invention, there is provided a container-handling spreader beam or the like having a pair of twistlock arrangements at each of two opposite ends thereof, each pair of twistlocks being positioned to co-act with the transversely positioned corner castings of an I.S.O. or "Sealand" type of container, wherein each twistlock assembly comprises a bearing bush supported in a frame of the beam for limited transverse movement, an elongated twistlock shaft turnably mounted in the bush and having a head shaped to engage with the top aperture of the said corner castings, means for turning the shaft in the bush about its longitudinal axis, and means for resiliently holding each twistlock assembly in a predetermined position relative to said frame, such means including a yoke member one end of which is attached to the bearing bush and the other end of which is formed with transversely disposed means co-acting with oppositely acting resilient means supported on and attached to said frame, wherein the predetermined positions of the twistlocks of each pair are such that the centre-to-centre spacing thereof corresponds to the mean centre-to-centre spacing of the top apertures of the transverse corner castings of an I.S.O. container and a "Sealand" container.

Preferably, the oppositely acting resilient means comprise a pair of spaced brackets fixed to the said frame and supporting a pair of compression springs between which is supported a projection of the yoke.

According to the invention furthermore, the twistlock arrangements also include means for determining when a twistlock head is properly positioned in a corner casting.

The invention is illustrated by way of example in the accompanying drawings in which, FIG. 1 is a schematic plan view of a container-handling spreader beam showing pairs of twistlock assemblies at "x"–"y".

Figure 1:
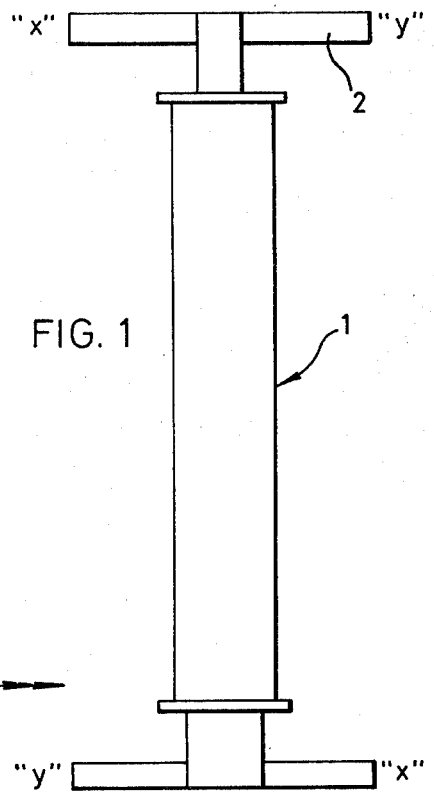

Referring to FIGS. 1 to 7 of the drawings, there is shown a container-handling spreader beam 1 having frames 2 each supporting, at "x", "y", a pair of twistlock assemblies which are positioned so that, in use, they co-act with the transverse corner castings 3 of a "Sealand" container, or the transverse corner castings 4 of an I.S.O. container.

Each twistlock assembly comprises a bearing bush 5 supported, by an annular flange 6, in an opening 7 in the frame 2 of the spreader beam 1 so as to be slidably movable relative thereto. Supported in the bush 5, by means of a nut 8, is an elongated twistlock shaft 9 having a head 10 which is shaped and sized to co-act with the top apertures of corner castings 3 and 4. The uppermost end of the shaft 9 is formed with a transverse groove 11 in which is fixed a key 12 which engages a centre disc 13 which, in turn, slides in a transverse groove in a twistlock lever member 14 having associated therewith a twistlock support pin 15 which is received in an upper part of the frame 2 to maintain the twistlock in a vertical position. The lever member 14 has attached thereto a turning mechanism 16 which serves to turn the shaft 9 through 90° between an operative and an inoperative position.

Figure 2:
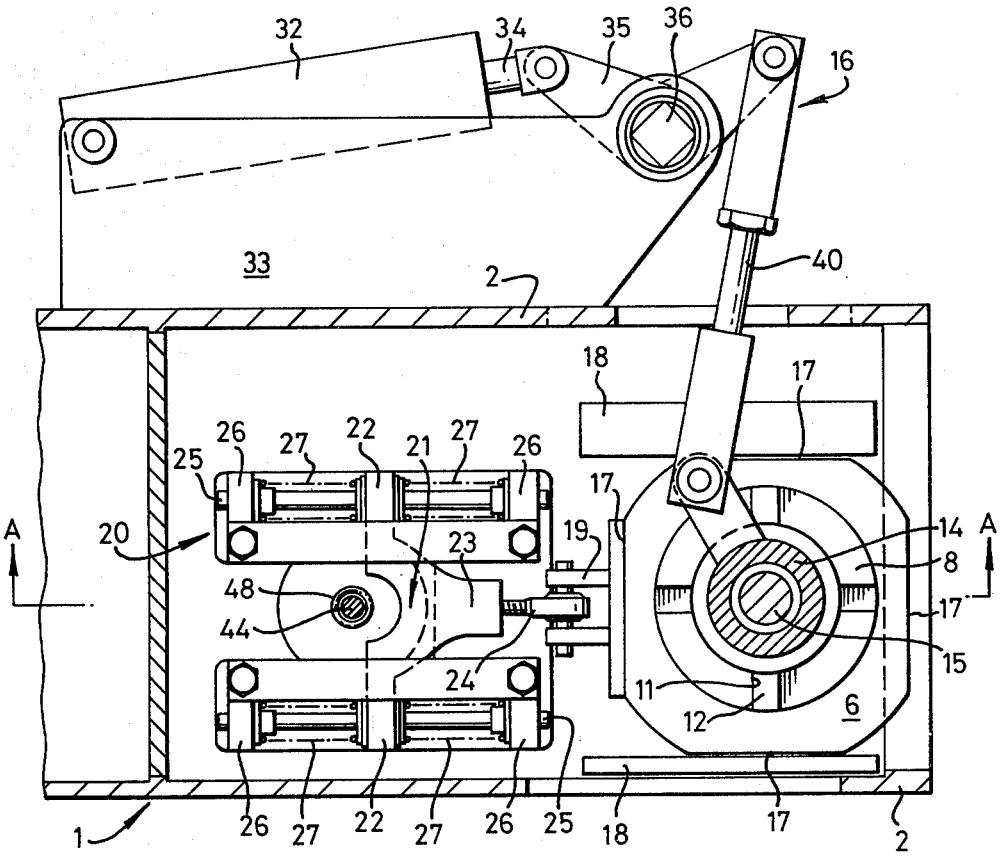
FIG. 2 is a section on the line B—B of FIG. 3 showing a twistlock assembly.
Figure 3:
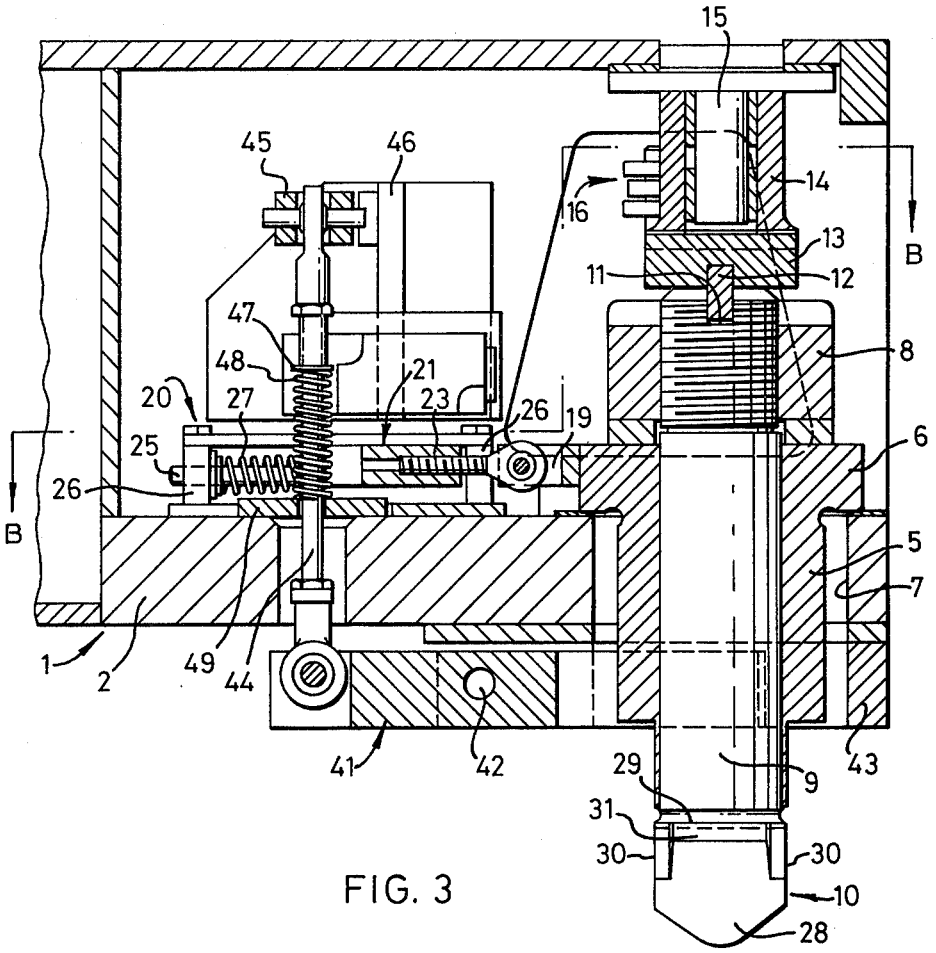
FIG. 3 is a section on the line A—A of FIG. 2.

The annular flange 6, as can be seen in FIG. 2, is formed with flats 17 two opposite one's of which co-act with guide members or pads 18 fixed to the frame 2 to allow sliding movement of the twistlock in a transverse direction. A third flat 17 has fixed thereto a bracket 19 for the attachment of a mechanism 20 for resiliently holding the twistlock in a predetermined position relative to the frame 2.

The mechanism 20 comprises a generally T-shaped yoke 21 having oppositely extending projections 22 and a tail portion 23. The tail portion 23 is attached, via a threaded eye bolt 24, to the bracket 19. Each projection 22 is resiliently held in position by being slidably mounted on a rod 25 supported at each end thereof in a bracket 26 fixed to the frame 2. Also supported on the bolt 25, between the projection 22 and each end of the bracket 26, is a compression spring 27. Thus, it will be seen that the position of the yoke 21 determines the horizontal position of the bush 5 of the twistlock.

Figure 4:
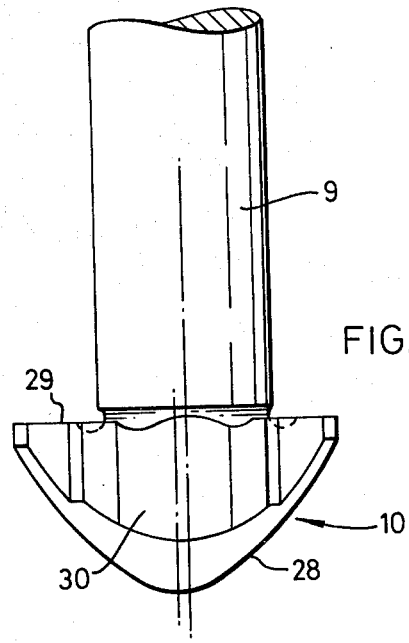
FIG. 4 is an elevation of a twistlock shaft.
Figure 5:
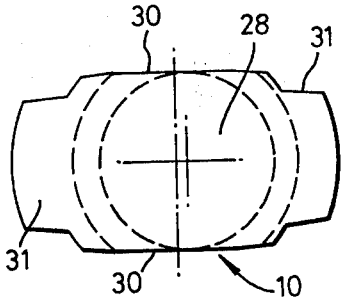
FIG. 5 is an end view corresponding to FIG. 4.
Figure 6:
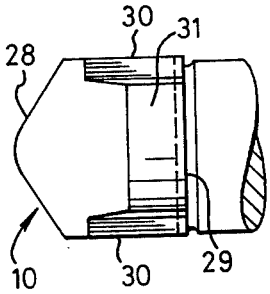
FIG. 6 is a part elevation of FIG. 5.

As is shown, particularly in FIGS. 4 to 6 of the drawings, the head 10 is of generally bullet-shaped formation having an arcuate guide or positioning surface 28 and two oppositely extending flat surfaces 29 which, when the twistlock is turned into its operative position, engage the inside surfaces of the corner casting to effect lifting of a container. The head 10 is also formed with two opposite "flats" 30 and to oppositely extending tongues 31 providing the flat surfaces 29, which tongues are of lesser width than the distance between the "flats" 30 as can be seen in FIG. 5. The length and width, as viewed in FIG. 5, of head 10 is such that it will pass through the top apertures of both a "Sealand" corner casting and an I.S.O. corner casting, the shapes of which are shown respectively at 3 and 4 in FIG. 7 of the drawings.

Figure 7:
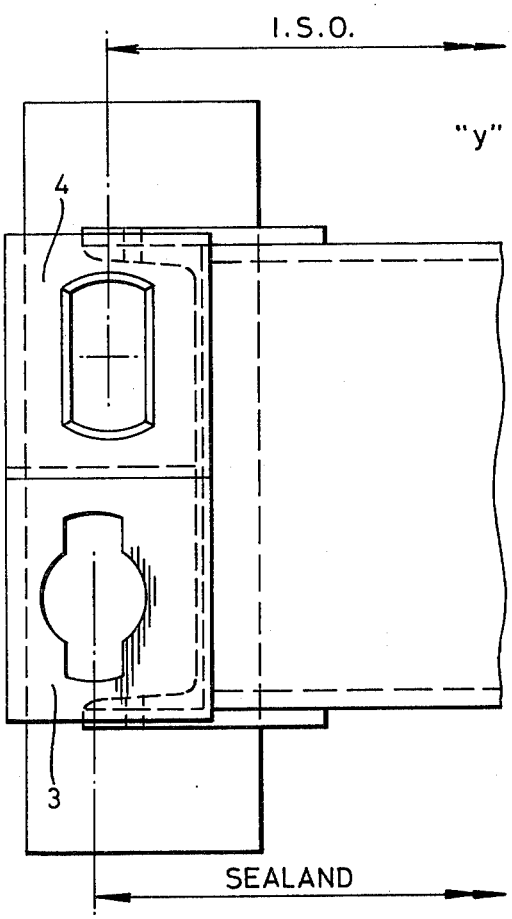
FIG. 7 is a part plan view, on a smaller scale, of a test rig showing the top aperture shapes and relative spacings of the corner castings of an I.S.O. container and a "Sealand" container.

As can be seen in the test rig shown in FIG. 7, the centre-to-centre spacing of the transverse corner castings of a "Sealand" container is greater then that of the corner castings 4 of an I.S.O. container. To enable the spreader beam to handle both types of container, the predetermined position (hereinbefore referred to) of each twistlock is such that it is midway between the centre line position of a "Sealand" casting and an I.S.O. casting. Therefore, in use, when the spreader beam is lowered onto a container, the twistlocks are moved transversely, as the guide surfaces 28 thereof engage the corner casting apertures, an amount approximately equal to one half of the difference in centres between the two types of container. Thus, the twistlocks will move, against the centering action of the springs 27, away from each other, or towards each other, depending on the type of container being handled. However, it will be appreciated that additional movement will be provided for at each twistlock to allow for manufacturing tolerances, and for inaccuracies of initial alignment of the spreader beam with the container by the gather guide members on the spreader beam or by, for example, the guides in a cellular ship or other vessel.

The twistlock shaft turning mechanism 16 hereinbefore referred to comprises, in generally known manner, an hydraulic ram 32 secured, at one end, to a bracket 33 attached to the frame 2. The ram piston rod 34 is connected to a lever 35 mounted on a lay shaft 36. The lever 35 is mounted so as to rotate relative to the shaft 36 and is connected to the twistlock lever member 14 via an adjustable push rod 40. Thus, movement of the ram piston rod 34 serves to turn the shaft 9 through 90°. This mechanism is also provided so as to permit transverse movement of the twistlock.

Each twistlock assembly also includes a probe mechanism 41 which is also of generally known construction and serves to determine when the head of the twistlock is properly positioned in, and removed from, a corner casting. This mechanism comprises a probe in the form of a forked lever 41, the forked end of which partially surrounds the lower end of the bearing bush 5. The lever 41 is hingedly mounted at 42 to a protector plate 43 and is coupled at its other end, by means of a rod 44, to a slave lever 45 which is hingedly mounted on a bracket 46 fixed to the frame 2.

The rod 44 is further provided with a collar 47, and a compression spring 48 is positioned to extend between the collar 47 and a bearing plate 49 fixed to the frame 2 so that the rod, and thus also the probe 41, are biassed into an inoperative position where the forked end of the probe hangs below the protector plate 43 in an inoperative position. The probe is shown in its operative position in FIG. 3 and is forced into that position by the corner casting when the head of the twistlock is properly positioned therein. The lever 45 is operatively associated with limit switches which serve to indicate when the twistlock is in or out of an operative position to permit rotation of the twistlock shaft 9 to take place. In this request, the ram 32 is controlled by a solenoid-operated valve which is in circuit with the limit switches of the probe mechanism so that it can only be operated at the correct time.

Figure 8:
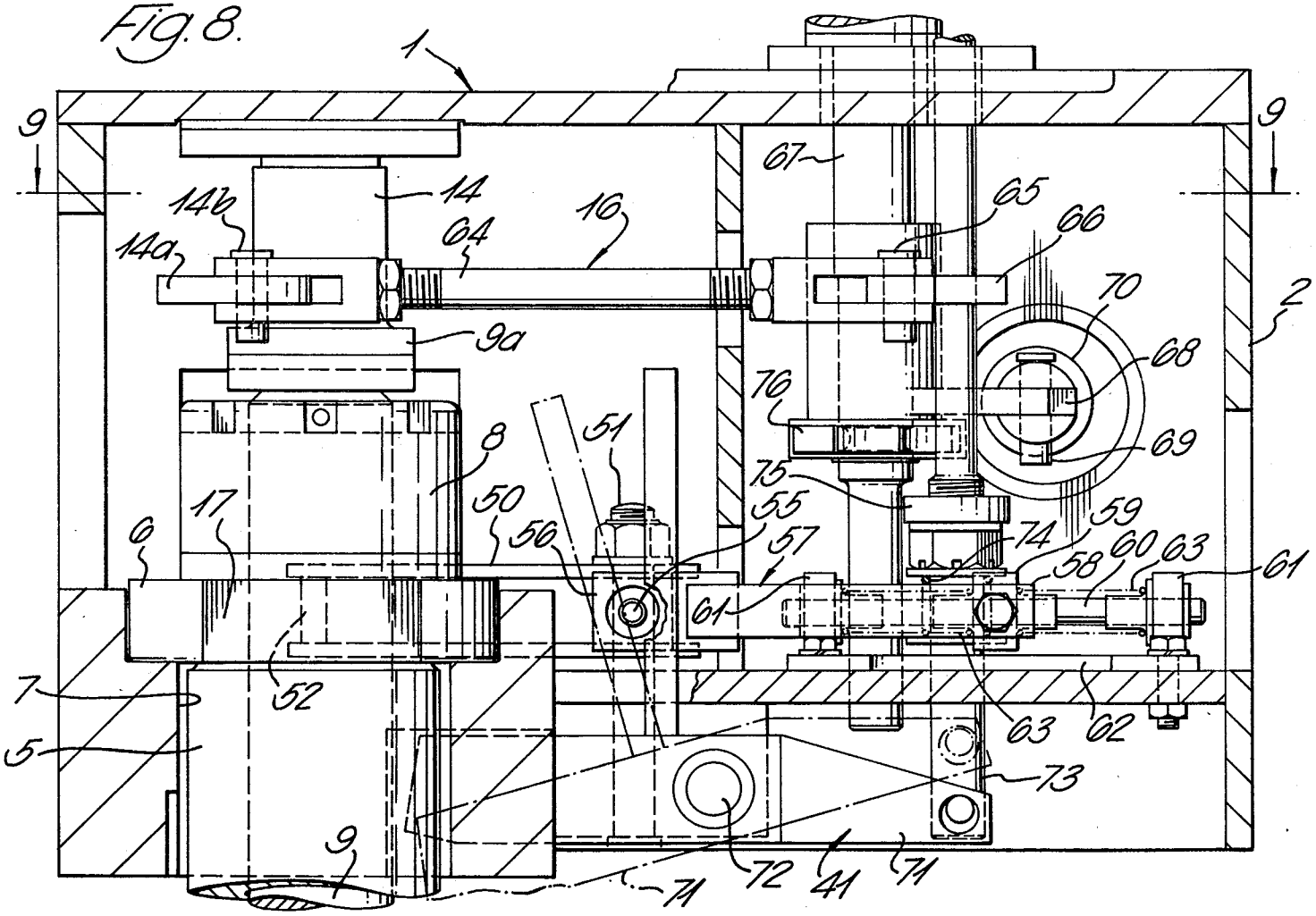
FIG. 8 is a sectional elevation of part of an alternative embodiment of spreader beam.
Figure 9:
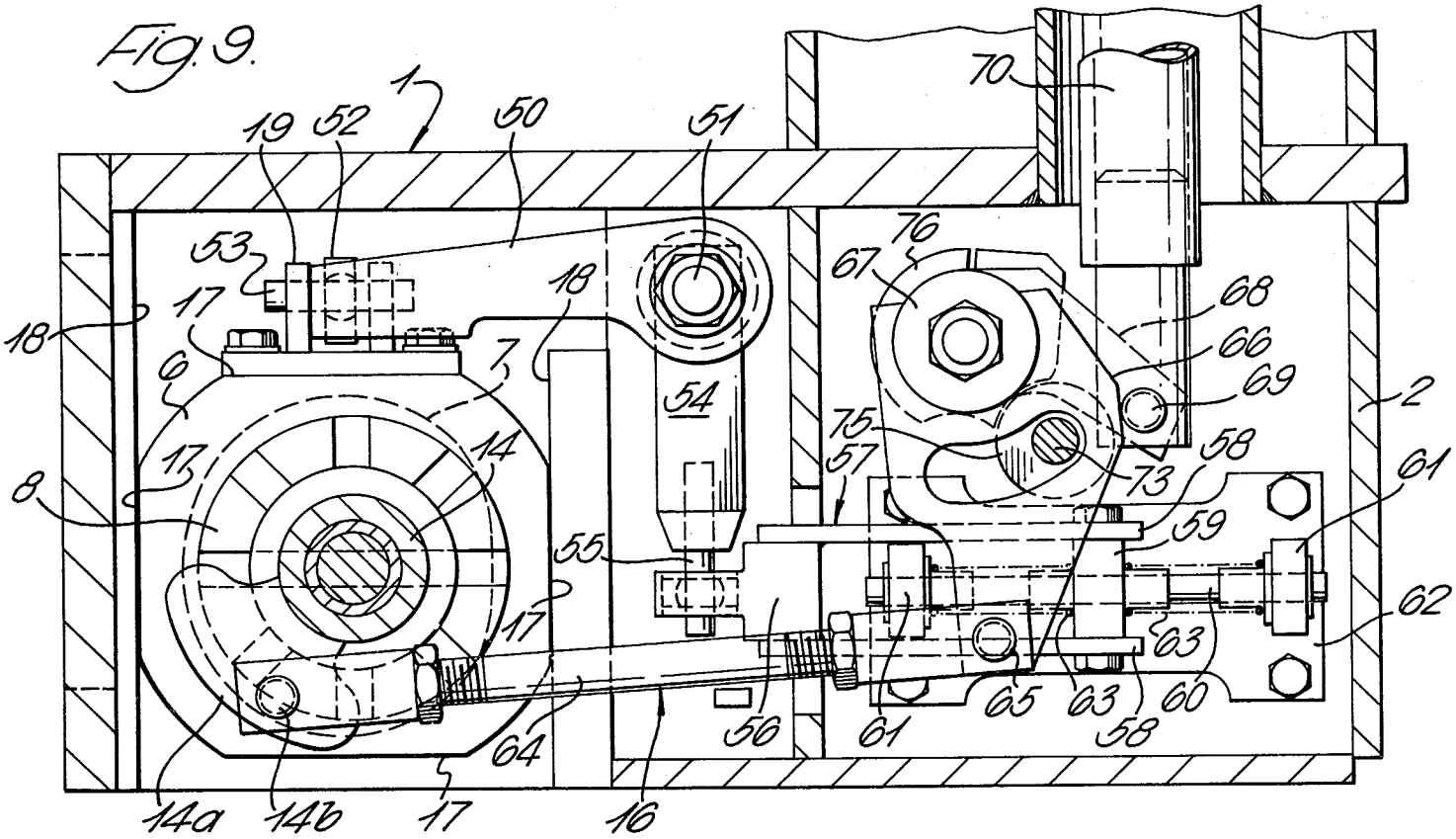
FIG. 9 is a section on the line 9—9 of FIG. 8.

Referring to FIGS. 8 and 9 of the drawings, there is shown one corner of an alternative embodiment of spreader beam. In the drawings there is shown part of a container-handling spreader beam 1 having a frame structure 2. The frame structure 2 supports two spaced pairs of twistlock assemblies which are positioned so that, in use, they co-act with the corner castings (not shown) of a "Sealand" or an I.S.O. container.

FIGS. 8 and 9 show only one twistlock assembly of one of said pairs. The twistlock assembly comprises a bearing bush 5 supported, by an annular flange 6, in an opening 7 in the frame structure 2 so as to be slidably movable relative thereto. Supported in the bush 5, by means of a nut 8, is an elongated twistlock shaft 9 having a head (not shown) which is shaped and sized to co-act with the top aperture of a corner casting. The uppermost end of the shaft 9 is connected, via a slidable connection 9*a*, to a lever member 14 having a transversely extending projection 14*a*. The projection 14*a* is connected, via a pivot pin 14*b*, to a turning mechanism 16 which serves to turn the shaft 9 through 90° between an operative position where the head engages a corner casting and an inoperative position whee the head is disengaged from the corner casting.

The annular flange 6, as can be seen in FIG. 9, is formed with flats 17 two opposite one's of which co-act with guide faces 18 provided on the frame 2 to allow sliding movement of the twistlock assembly in a transverse direction. A third flat 17 has fixed thereto a bracket 19 to which is attached one end of one arm 50 of a bellcrank lever which is hingedly mounted on a pivot pin 51 fixed to the frame 2. The arm 50 has two spaced elements interconnected at their free ends of a transverse plate 52 through which a pin 53 extends to connect the arm 50 to the bracket 19. The other arm 54 of the bellcrank lever is of circular cross-section having a projecting pin 55 extending from the free end thereof. The pin 55 extends through an opening in a tail portion 56 of a yoke member 57. The member 57 has a pair of yoke arms 58 extending outwardly from the tail portion 56, the free ends of the arms 58 supporting a transversely disposed cross-member 59. The cross-member 59 is slidably mounted on a guide rod 60 supported, at each end thereof, in a bracket 61, the brackets 61 being fixed to a base plate 62 which is attached to the frame structure 2. Also mounted on the guide rod 60, between the cross-member 59 and each bracket 61, is a compression spring 63. Thus, it will be seen that the cross-member 59, and thus the yoke member 57, are resiliently held between the springs 63. This, in turn, resiliently holds the twistlock assembly, via the bellcrank lever, in a predetermined position.

The turning mechanism 16 comprises an adjustable link 64 attached, at one end, to the pivot pin 14*b* and at its other end, via a pivot pin 65, to a transverse lever 66 fixed to a pivot shaft 67 mounted in the frame 2. The pivot shaft 67 has fixed thereto a second transverse lever 68 to which is attached, via a pivot pin 69, to one end of a tubular actuator shaft 70. In practice, the other end of the shaft 70 is attached to a turning mechanism corresponding to that just described which is associated with the other twistlock assembly of the pair. The shaft 70 is movable lengthwise, for example by means of an hydraulic jack (not shown), to angularly turn the twistlock shafts 9 of both twistlock assemblies simultaneously.

Each twistlock assembly also has operatively associated therewith a probe mechanism 41 which serves to indicate when the head of the twistlock is properly positioned in, and removed from, the top aperture of its co-acting corner casting. This mechanism comprises a probe member in the form of a lever 71, one end of which is forked and partially surrounds the lower end of the bearing bush 5. The lever 71 is hingedly mounted at 72 and the other end thereof is attached to a vertical shaft 73. Normally, the lever 71 is in the position shown in chain dot lines in FIG. 8 into which it is biassed by a spring 74. In this position, a collar 75 on the shaft 73 is moved upwardly into a recessed collar 76 fixed to the pivot shaft 67 and prevents operation of the turning mechanism 16 and thus turning of the twistlock shaft 9.

In use, when the spreader beam 1 is lowered onto a container, as the head of the twistlock shaft 9 enters the top aperture of its co-acting corner casting, the lever 71 is turned about its pivot 72 into the full line position shown in FIG. 8 and thereby indicates that the twistlock is positioned for a lifting operation. This action moves the collar 75 out of engagement with the collar 76 so that the turning mechanism 16 can be operated to turn the twistlock shaft 9 and thereby engage the head thereof with the corner casting. When the mechanism 16 is operated to disengage the head of shaft 9 from the corner casting and the beam is lifted away from the container, the lever 71 will return to its chain dot line position.

We claim:

1. A container-handling spreader beam or the like having a pair of twistlock assemblies at each of two ends thereof, each pair of said twistlock assemblies being positioned to co-act with the transversely positioned corner castings of an I.S.O. or "Sealand" type container, wherein each of said twistlock assemblies comprises a bearing bush supported in a frame of the beam for limited transverse movement, an elongated twistlock shaft turnably mounted in said bearing bush and having a head shaped to engage with the top aperture of one of said corner castings, means for turning the said shaft in said bush about its longitudinal axis, and means for resiliently holding each said twistlock assembly in a predetermined position relative to said frame, said means including a yoke member one end of which is attached to said bearing bush and the other end of which is formed with transversely disposed means co-acting with oppositely acting resilient means supported on and attached to said frame, the predetermined positions of said twistlocks of each said pair being such that the centre-to-centre spacing of said pair of twistlocks corresponds to the mean centre-to-centre spacing of said top apertures of said transverse corner castings of said I.S.O. container and said "Sealand" container.

2. A spreader beam as claimed in claim 1, wherein said yoke member is adjustably attached to said bearing bush by means of a threaded bolt.

3. A spreader beam as claimed in claim 2, wherein the said other end of said yoke member has a pair of transversely disposed oppositely extending projections each co-operating with said oppositely acting resilient means.

4. A spreader beam as claimed in claim 3, wherein said oppositely acting resilient means comprise a pair of spaced brackets fixed to said frame on opposite sides of each said yoke projection, and a compression spring positioned between each said bracket and the co-acting face of said yoke projection.

5. A spreader beam as claimed in claim 4, in which each said yoke projection is slidably mounted on a guide rod extending between said pair of co-acting brackets.

6. A spreader beam as claimed in claim 5, in which said compression springs are mounted on said guide rod.

7. A spreader beam as claimed in claim 1, wherein said bearing bush is supported in an opening in said frame of said beam by means of an integral annular flange having oppositely positioned flats which co-act with guide members or pads provided on said frame.

8. A spreader beam as claimed in claim 1, wherein said means for turning said twistlock shaft comprise an hydraulic ram connected, via an adjustable linkage, to a lever member coupled to said shaft.

9. A spreader beam as claimed in claim 8, in which said lever member is coupled to said twistlock shaft via a diametrically disposed projection which engages a corresponding groove in the end of said shaft.

10. A spreader beam as claimed in claim 1, including means for determining when a twistlock head is properly positioned in a corner casting.

11. A spreader beam as claimed in claim 1, wherein said means for resiliently holding each said twistlock assembly in a predetermined position relative to said frame comprises a bellcrank lever pivotally supported on said frame structure, one arm of said lever being attached to said bearing bush and the other arm of said lever being attached to a yoke member having a transversely disposed cross-member acted upon by oppositely acting resilient means supported on said frame structure.

12. A spreader beam as claimed in claim 11, wherein said yoke member comprises a tail portion attached to said other arm of said lever, and a pair of yoke arms extending outwardly from said tail portion, said cross-member being secured between the free ends of said yoke arms.

13. A spreader beam as claimed in claim 11, wherein said oppositely acting resilient means comprise a compression spring positioned on each side of said cross-member, the springs being mounted on a guide rod extending between end brackets attached to said frame structure.

14. A spreader beam as claimed in claim 11, wherein said other arm of said lever is of circular cross-section and has a projecting pin at the free end thereof said pin co-acting with said yoke member.

15. A spreader beam as claimed in claim 11, wherein said one arm of said bellcrank lever comprises a pair of spaced elements the free ends of said elements being connected by a transverse plate co-acting with a bracket secured to said bearing bush.

16. A spreader beam as claimed in claim 11, wherein said means for turning said twistlock shaft in said bearing bush comprises a linkage arrangement coupled to a lever member operatively associated with said twistlock shaft, and means such as an hydraulic jack arranged to impart angular turning movement to said twistlock shaft via said linkage arrangement.

17. A spreader beam as claimed in claim 11, including means for determining when a twistlock head is properly positioned in a corner casting.

* * * * *